US009816299B2

(12) United States Patent
Pickar

(10) Patent No.: US 9,816,299 B2
(45) Date of Patent: Nov. 14, 2017

(54) DOOR HANDLE ASSEMBLY FOR VEHICLE COMPARTMENT

(75) Inventor: Barbara J. Pickar, New Hampton, IA (US)

(73) Assignee: Trimark Corporation, New Hampton, IA (US)

( * ) Notice: Subject to any disclaimer, the term of this patent is extended or adjusted under 35 U.S.C. 154(b) by 584 days.

(21) Appl. No.: 13/095,581

(22) Filed: Apr. 27, 2011

(65) Prior Publication Data

US 2012/0272695 A1 Nov. 1, 2012

(51) Int. Cl.

| | |
|---|---|
| ***E05B 41/00*** | (2006.01) |
| ***E05B 5/00*** | (2006.01) |
| ***E05C 1/14*** | (2006.01) |
| ***E05B 83/44*** | (2014.01) |
| *E05B 47/06* | (2006.01) |
| *E05B 81/06* | (2014.01) |
| *E05B 81/24* | (2014.01) |
| *E05B 13/00* | (2006.01) |

(52) U.S. Cl.

CPC ..... *E05C 1/145* (2013.01); *E05B 5/00* (2013.01); *E05B 83/44* (2013.01); *E05B 13/002* (2013.01); *E05B 47/0657* (2013.01); *E05B 81/06* (2013.01); *E05B 81/25* (2013.01); *Y10T 70/5155* (2015.04); *Y10T 292/1022* (2015.04)

(58) Field of Classification Search

CPC ..... E05B 5/00; E05B 7/00; E05C 1/004
USPC ..... 70/208, 210, 370, 451, 466, 452, 448, 70/449, 368, DIG. 40, 371; 403/21, 22
See application file for complete search history.

(56) References Cited

U.S. PATENT DOCUMENTS

| | | | | |
|---|---|---|---|---|
| 3,668,907 | A * | 6/1972 | Pastva, Jr. | 70/153 |
| 3,785,686 | A * | 1/1974 | Armstrong | 292/336.3 |
| 4,138,869 | A * | 2/1979 | Pelcin | 70/151 R |
| 4,312,202 | A * | 1/1982 | Pastva et al. | 70/472 |
| 4,850,209 | A * | 7/1989 | Weinerman et al. | 70/208 |
| D303,620 | S * | 9/1989 | Russell et al. | D8/313 |

(Continued)

FOREIGN PATENT DOCUMENTS

GB 2 272 019 A 5/1994

OTHER PUBLICATIONS

West Alloy Diecastings Limited, Interior Latches, WAC V5/FAS/IEA/1M/02.078 Brochure, 11 pages.

(Continued)

*Primary Examiner* — Peter M Cuomo
*Assistant Examiner* — Ifeolu Adeboyejo
(74) *Attorney, Agent, or Firm* — McKee, Voorhees & Sease, PLC

(57) ABSTRACT

A handle assembly is provided for use on storage compartment doors of a vehicle. The assembly includes inner and outer housings residing on opposite sides of the door. The handle assembly plunger resides on the inside of the door, rather than between the outside and inside door skins. An exterior handle can be grasped from either side for moving the plunger from an extended latched position to a retracted unlatched position for opening the door. An interior egress handle is provided to open the door from inside the compartment, as a safety feature. A key cylinder on the outer housing allows the handle assembly to be locked to preclude accidental or unauthorized opening of the door. The handle assembly allows the door to be opened by electric remote power and to be closed by slam action.

18 Claims, 21 Drawing Sheets

(56) References Cited

U.S. PATENT DOCUMENTS

| | | | | | |
|---|---|---|---|---|---|
| 4,892,338 | A | * | 1/1990 | Weinerman et al. | 292/35 |
| 4,911,487 | A | * | 3/1990 | Rachocki | 292/216 |
| 5,058,937 | A | * | 10/1991 | Miehe et al. | 292/34 |
| D339,050 | S | | 9/1993 | Gleason et al. | |
| D346,731 | S | | 5/1994 | Larsen et al. | |
| 5,439,260 | A | * | 8/1995 | Weinerman et al. | 292/48 |
| D369,084 | S | | 4/1996 | McConnell et al. | |
| D369,089 | S | | 4/1996 | Zenner | |
| D371,500 | S | | 7/1996 | McConnell et al. | |
| D373,298 | S | | 9/1996 | Miehe et al. | |
| 5,595,076 | A | * | 1/1997 | Weinerman et al. | 70/208 |
| 5,606,882 | A | | 3/1997 | Larsen et al. | |
| D419,421 | S | | 1/2000 | Larsen et al. | |
| D425,393 | S | | 5/2000 | Larsen et al. | |
| D427,045 | S | | 6/2000 | Larsen et al. | |
| 6,101,853 | A | * | 8/2000 | Herr | 70/109 |
| 6,240,752 | B1 | * | 6/2001 | Larsen et al. | 70/208 |
| D459,969 | S | | 7/2002 | Larsen et al. | |
| 6,490,895 | B1 | * | 12/2002 | Weinerman et al. | 70/208 |
| 6,513,353 | B1 | * | 2/2003 | Weinerman et al. | 70/208 |
| 6,547,290 | B1 | * | 4/2003 | Zenner et al. | 292/173 |
| 6,561,557 | B2 | * | 5/2003 | Choi | 292/336.3 |
| 6,701,761 | B1 | * | 3/2004 | Chang et al. | 70/337 |
| 6,708,537 | B1 | | 3/2004 | Eschweiler et al. | |
| D489,957 | S | | 5/2004 | Lane | |
| D496,576 | S | | 9/2004 | Pickar et al. | |
| D519,823 | S | | 5/2006 | Pickar et al. | |
| D537,701 | S | | 3/2007 | Houdek et al. | |
| 7,232,162 | B2 | * | 6/2007 | Pickar | 292/175 |
| 7,237,812 | B2 | * | 7/2007 | Tweedy | 292/40 |
| D564,855 | S | | 3/2008 | Hidding et al. | |
| 7,552,954 | B2 | * | 6/2009 | Rozo et al. | 292/336.3 |
| D598,729 | S | * | 8/2009 | Eschweiler et al. | D8/302 |
| 2008/0258867 | A1 | * | 10/2008 | Harris et al. | 340/5.64 |

OTHER PUBLICATIONS

West Alloy Limited, "2000 Caraloc Assembly", http://www.westalloy.com/web/index.php?id=71, printed from Internet Apr. 11, 2011, 2 pages.

* cited by examiner

DOOR HANDLE ASSEMBLY FOR VEHICLE COMPARTMENT

BACKGROUND OF THE INVENTION

Certain types of vehicles commonly have storage compartments for baggage, equipment, and supplies. For example, recreational vehicles (RVs) typically have numerous compartments with doors hinged at the top, bottom, or side, with a cam lock or a handle on the door for opening and closing the door. Typically, handles for such storage compartment doors have a plunger which resides within the door, between the inner and outer door skins. Currently in the RV industry, lower end baggage doors use manually locking cam locks (lowest cost) and/or non-locking finger twist cam locks to secure the small doors. These low end manual locks generally are not capable of having power locking abilities with a slam action plunger. Higher end baggage handles may be power lock capable. Higher end baggage doors typically use a two-point application and not the direct drive slam action plunger seen in lower end baggage doors. Lowest cost cam locks are not desirable for the RV compartment door which may be dropped from a raised position and fall by gravity so as to slam shut. Such slam action is detrimental to the life of lowest cost locks as they are not slam capable and if rotated to a locked position and then closed, can cause paint damage. Also, lowest cost cam locks or current high cost handle assemblies typically do not allow for remote or power actuation by a key fob or key pad.

Recent door designs are becoming much thinner than in the past, so as to reduce weight and cost. Such thin doors make it more difficult for mounting conventional door handles. For example, on doors less than 1.26 inch, the inside skin must be cut to fit the plunger of the conventional handle.

Accordingly, a primary objective of the present invention is the provision of an improved handle assembly for a storage compartment door of a vehicle.

Another objective of the present invention is the provision of an improved handle assembly which can be used on thin compartment doors.

Another objective of the present invention is the provision of the inner housing which also acts as a mounting flange on the door inner surface.

Another objective of the present invention is the provision of a handle assembly which can be used on compartment doors less than 1.26 inch thick.

A further objective of the present invention is the provision of a handle assembly for a vehicle compartment door which can withstand slam action forces of the door.

Still another objective of the present invention is the provision of a handle assembly for a vehicle compartment door which has the ability for power locking and unlocking.

Yet another objective of the present invention is the provision of a handle assembly for a vehicle compartment door which is non-handed.

Still another objective of the present invention is the provision of a handle assembly for a vehicle compartment door which can be gripped with the palm up or the palm down to open the door.

Still another objective of the present invention is the provision of a handle assembly for a vehicle compartment door that is side hinged which can be operated with either hand to open the door.

Another objective of the present invention is the provision of a handle assembly for a compartment door on a vehicle which can be approached from either the top or the bottom for grasping by a person.

Still another objective of the present invention is the provision of a vehicle compartment door assembly having an interior egress knob to open the door from inside the compartment.

A further objective of the present invention is the provision of a handle assembly for a compartment door on a vehicle which is economical to manufacture and durable and safe in use.

SUMMARY OF THE INVENTION

The handle assembly of the present invention is intended for use on compartment doors on vehicles such as RVs and utility vehicles. The handle assembly is designed for use on a top-hinged door, but can also be used on doors hinged on either side edge or along the bottom edge. The handle assembly includes an inner housing which resides on the inner skin of the compartment door and an outer housing recessed within a cut-out in the outer skin of the compartment door. A handle is pivotally mounted on the outer housing. A plunger is slidably mounted on the inner housing, but does not reside between the inner and outer skins of the door. The plunger can be moved between an extended latched position to retain the door closed and a retracted unlatched position to open the door. When the handle assembly is mounted in a top-hinged door, the handle can be gripped from the top with the palm down or from the bottom with the palm up and pulled from a neutral or rest position wherein the plunger is extended and latched behind the door frame and an outwardly pulled position wherein the plunger is retracted from the frame to allow the door to be opened. The plunger is centrally mounted on the inner housing so that the handle assembly is non-handed for mounting on any edge of the door. An optional egress knob is rotatably mounted on the inner housing so as to retract the plunger from inside the compartment, whether the handle assembly is locked or unlocked so as to provide a safety override in case of a person inadvertently getting locked inside a compartment. The handle assembly may include a key lock for locking and unlocking the assembly. An optional power lock actuator may also be operatively connected to the handle assembly for remotely locking and unlocking the assembly. The design and inter-relation between the inner and outer housings allows for application on doors having a thickness of 0.79-1.25 inch, without the use of spaces. On thinner doors, spacers may be used between the inner and outer housings to achieve a minimum thickness of at least approximately 0.79 inch.

DETAILED DESCRIPTION OF THE PREFERRED EMBODIMENTS

Figure 22:
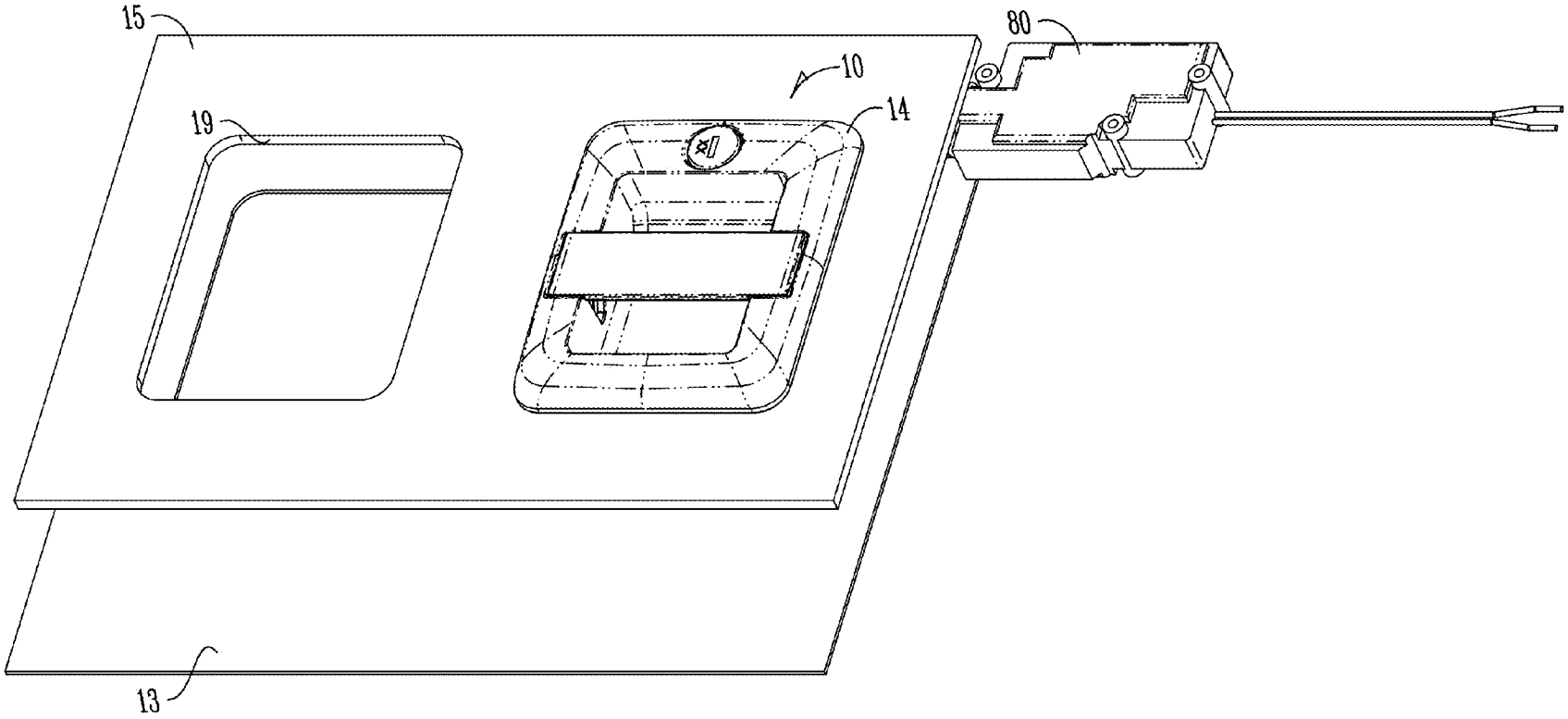
FIG. 22 is a perspective view of the handle assembly mounted on a compartment door.
Figure 23:
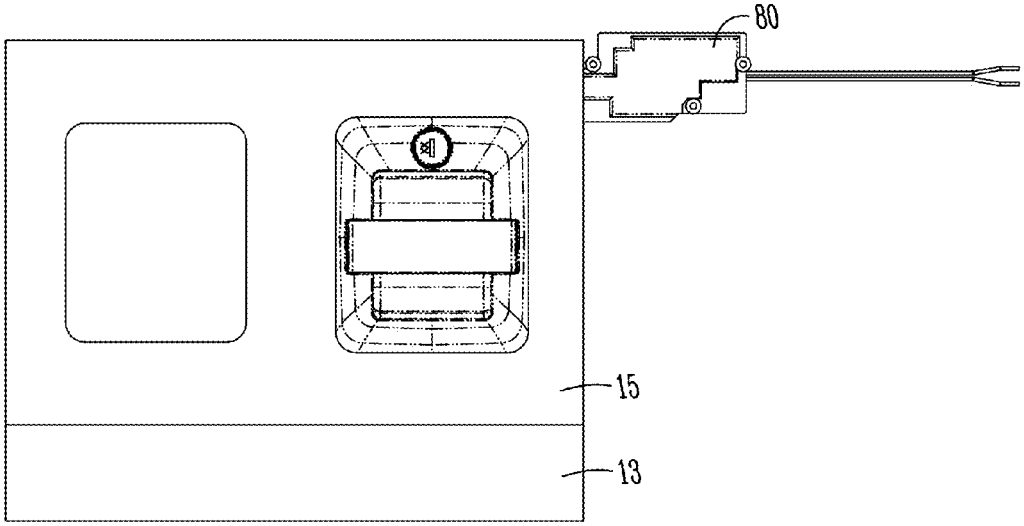
FIG. 23 is a side elevation view of the assembly shown in FIG. 22.
Figure 24:
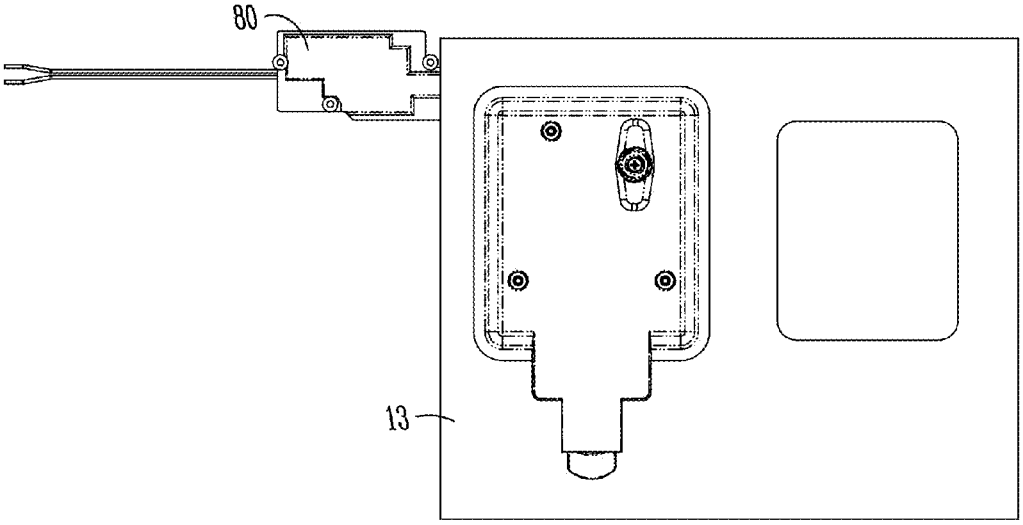
FIG. 24 is a front elevation view of the assembly shown in FIG. 22.
Figure 25:
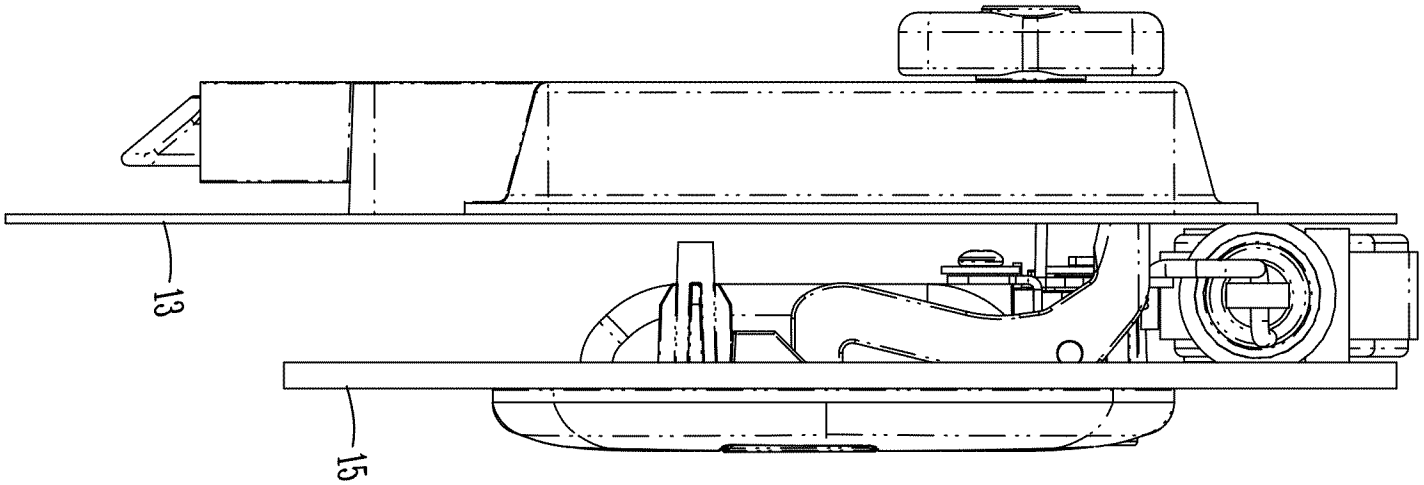
FIG. 25 is a rear elevation view of the assembly shown in FIG. 22.

The handle assembly of the present invention is generally designated in the drawings by the reference numeral 10. The assembly 10 includes an inner housing 12 and an outer housing 14. The inner housing 12 resides against the inner skin 13 of the door, without any cut-outs in the interior skin 13. The outer housing 14 resides on the outer door skin 15, which includes a cut-out for the components associated with the outer housing 14. Thus, the compartment door is sandwiched between the inner and outer housings 12, 14. FIG. 22 shows a cut-out 19 in the outer skin 15, but it is understood that only one cut-out 19 is needed for the housing 14.

Figure 1:
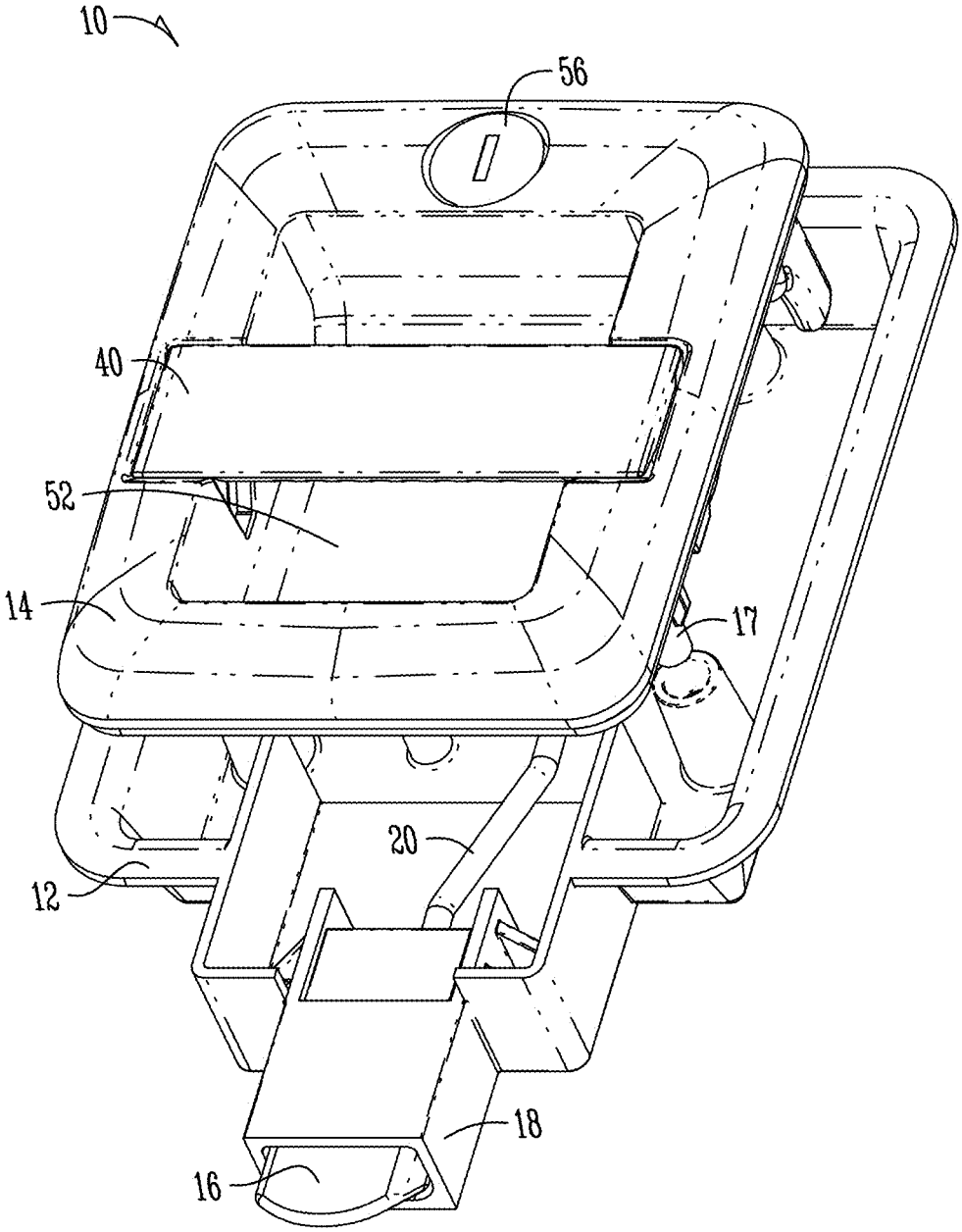
FIG. 1 is a perspective view of the handle assembly of the present invention.
Figure 2:
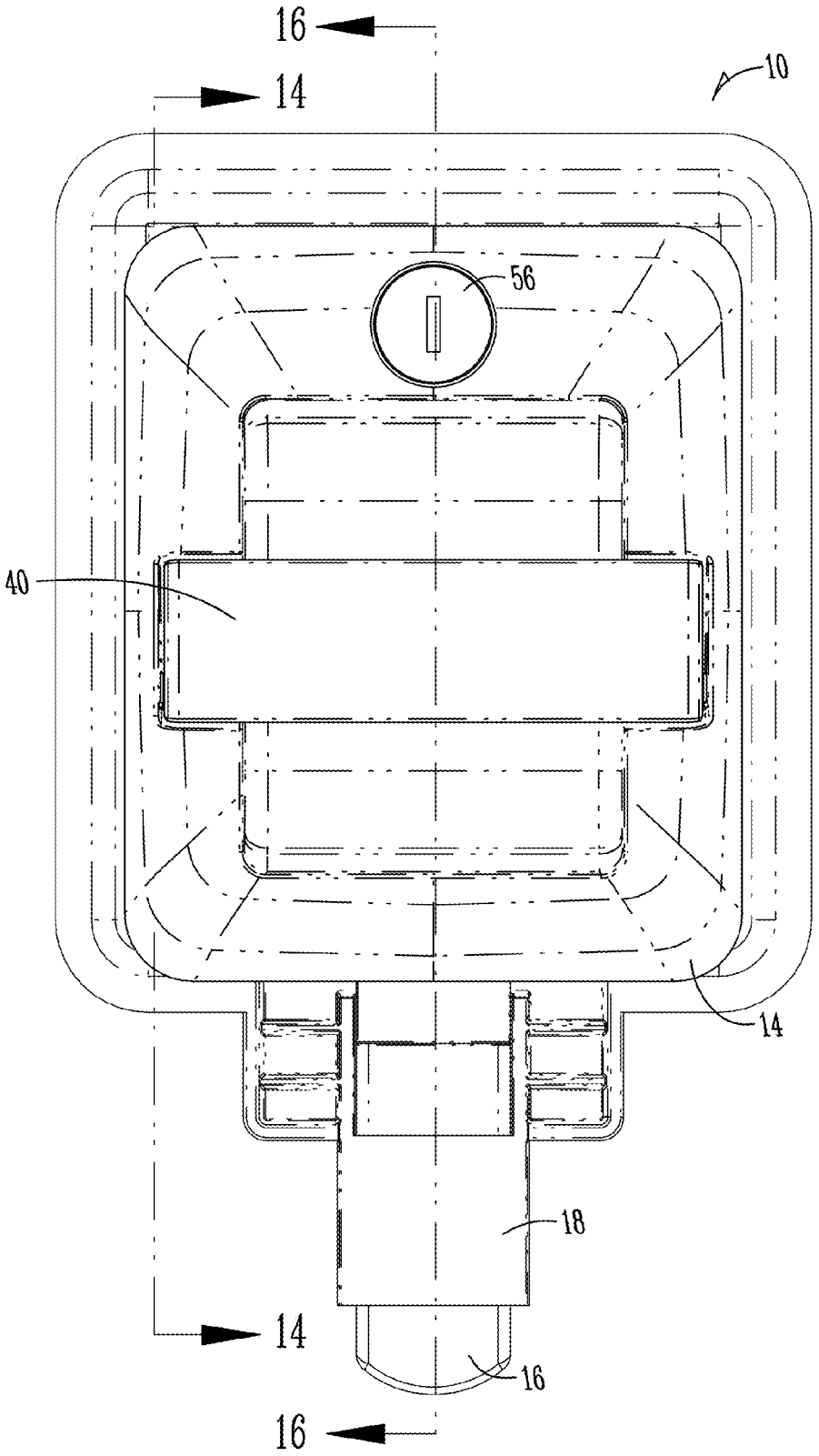
FIG. 2 is a front of exterior plan view of the handle assembly as oriented on a top-hinged door.
Figure 3A:
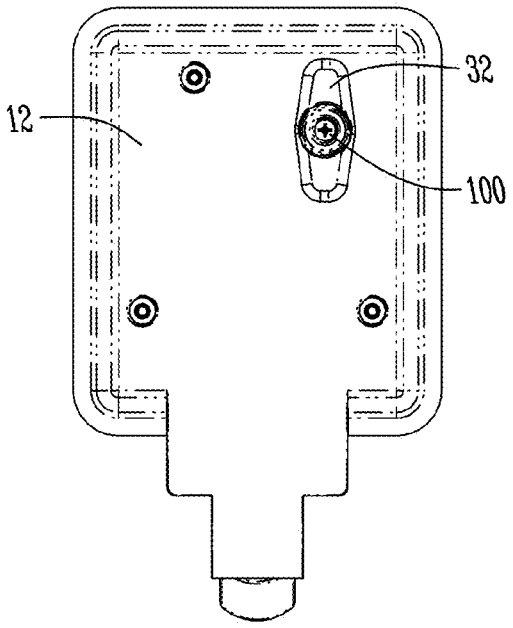
FIG. 3A is a rear or interior plan view of the handle assembly with a safety egress knob on the inner housing.
Figure 3B:
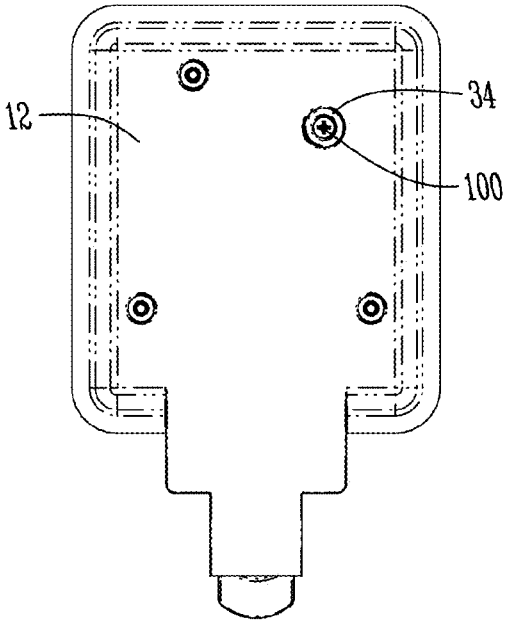
FIG. 3B is a view similar to FIG. 3A showing an alternative embodiment of the handle assembly without the egress knob.
Figure 4A:
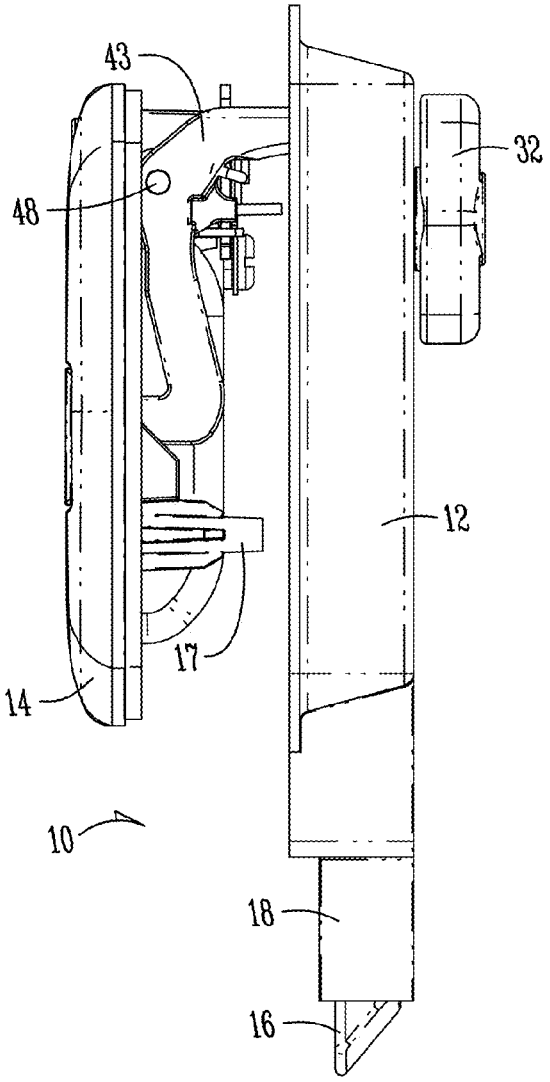
FIG. 4A is a side elevation view of the handle assembly having the egress knob.
Figure 4B:
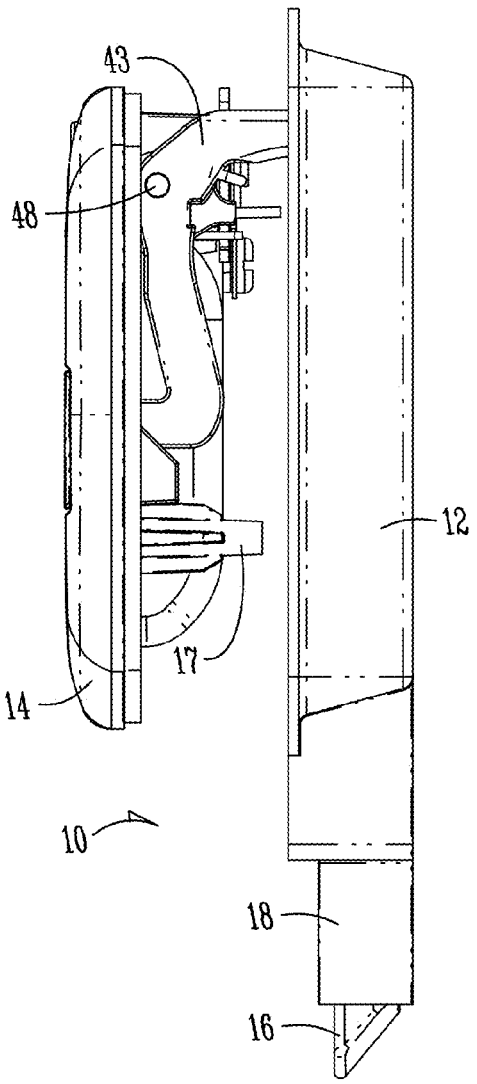
FIG. 4B is a side elevation view of the handle assembly of the alternative embodiment without the egress knob.
Figure 5A:
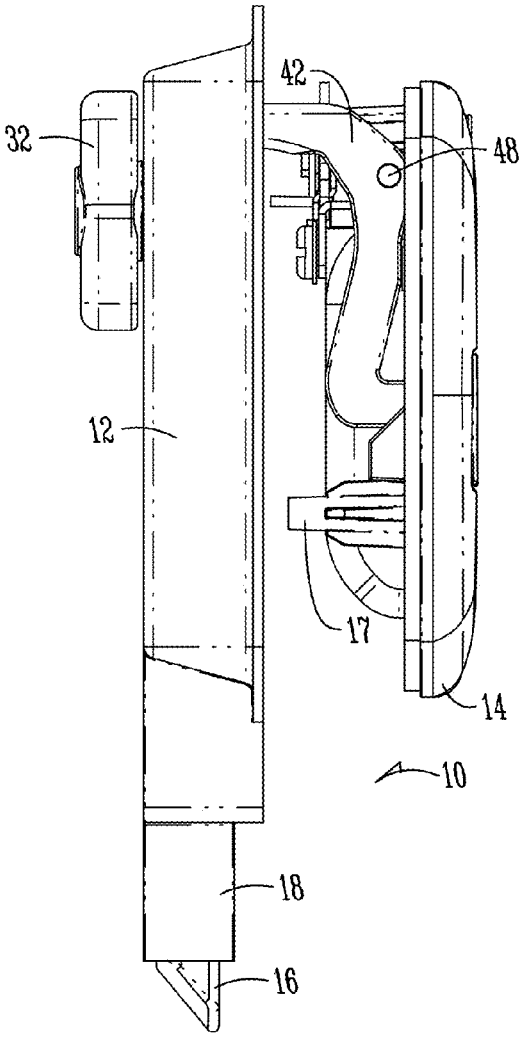
FIG. 5A is a side elevation view from the opposite side as FIG. 4A.
Figure 5B:
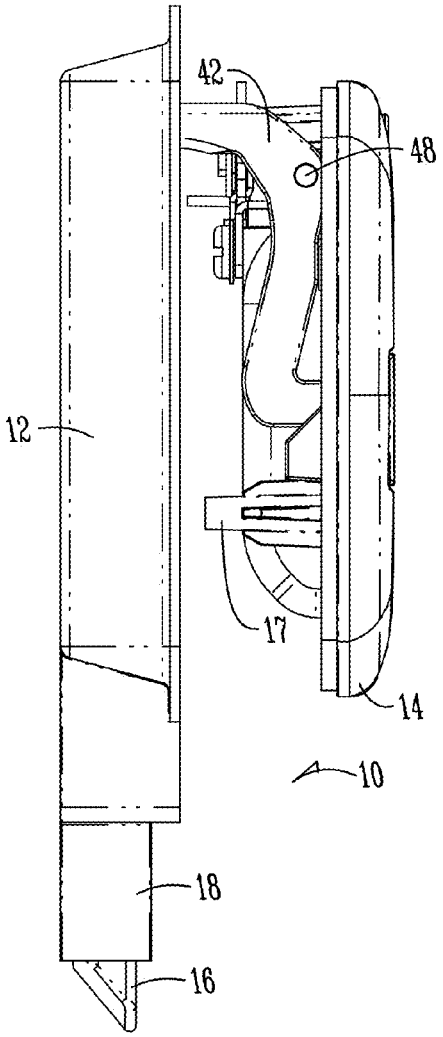
FIG. 5B is a side elevation view of the alternative embodiment from the opposite side of FIG. 4B.
Figure 6A:
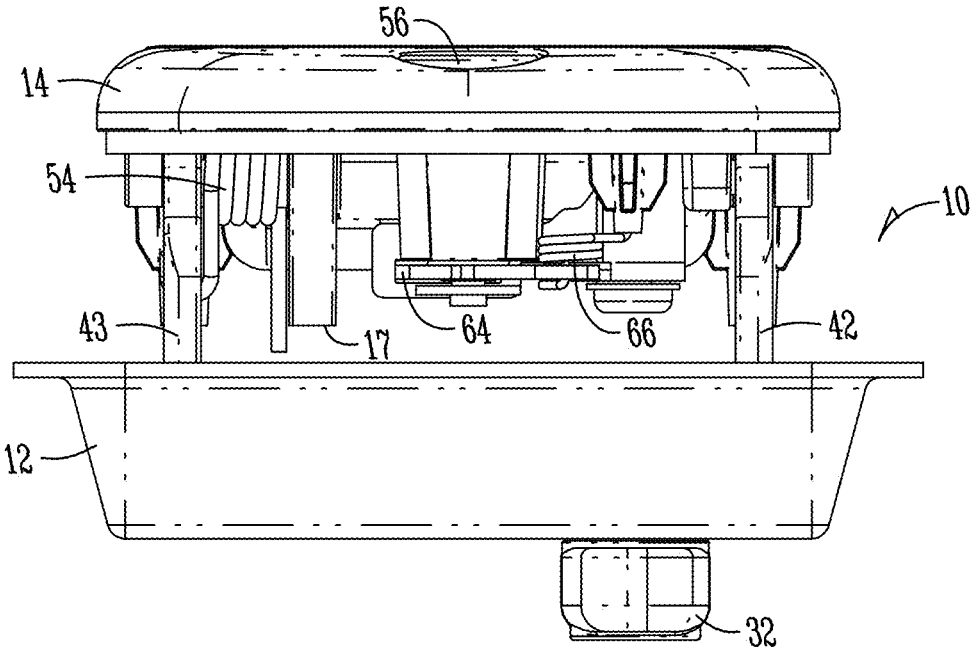
FIG. 6A is a top elevation view of the handle assembly having the egress knob.
Figure 6B:
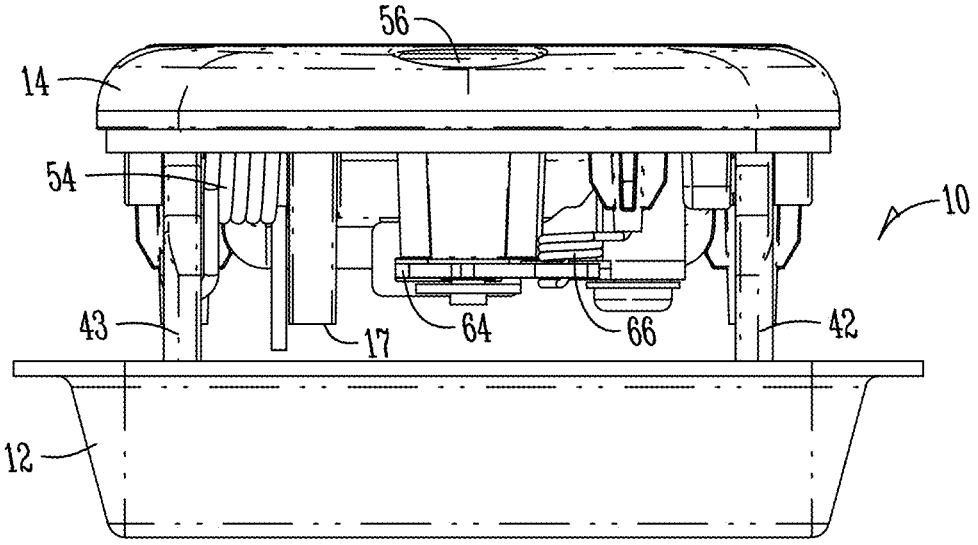
FIG. 6B is a view similar to FIG. 6A showing the alternative embodiment without an egress knob.
Figure 7A:
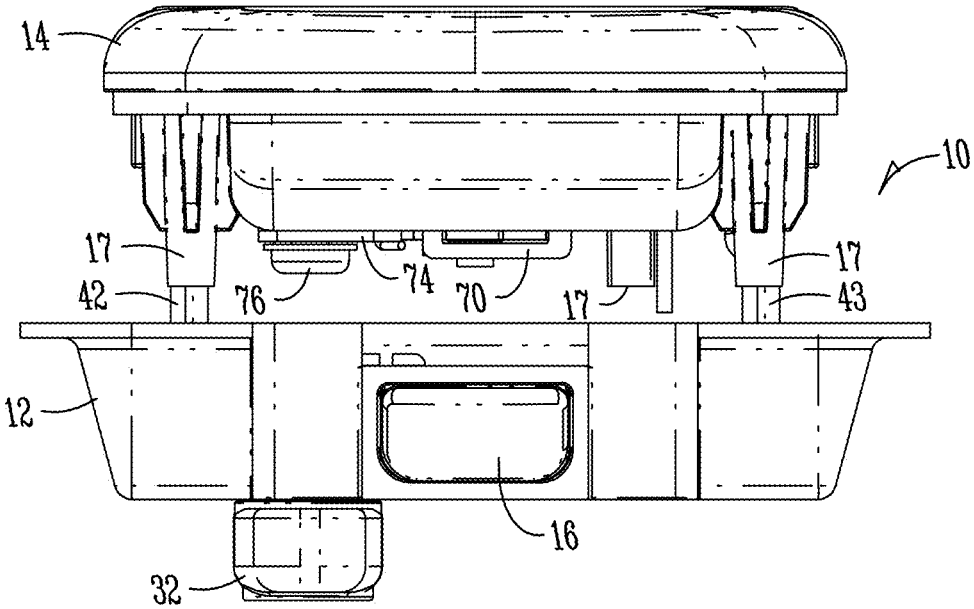
FIG. 7A is a bottom elevation view of the handle assembly having an egress knob.
Figure 7B:
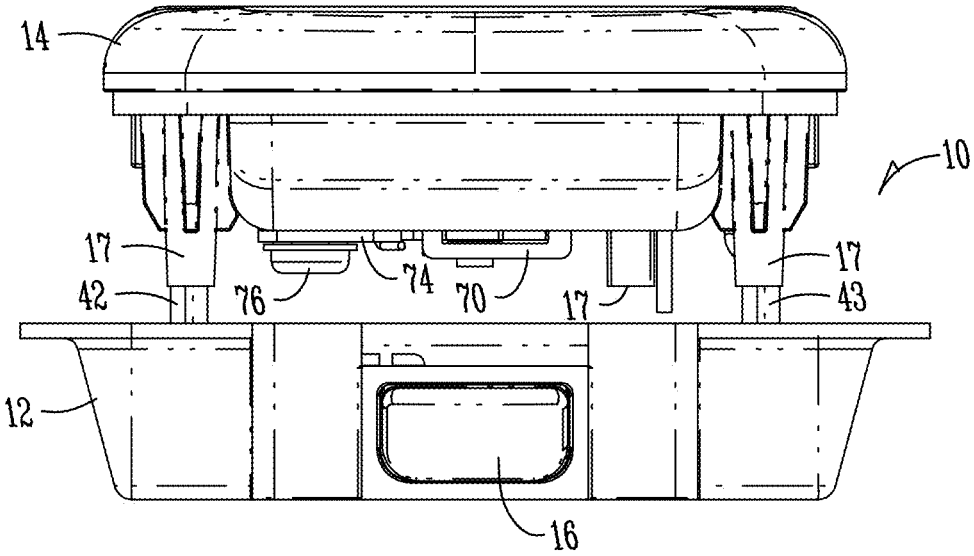
FIG. 7B is a bottom elevation view of the alternative embodiment assembly without an egress knob.
Figure 8A:
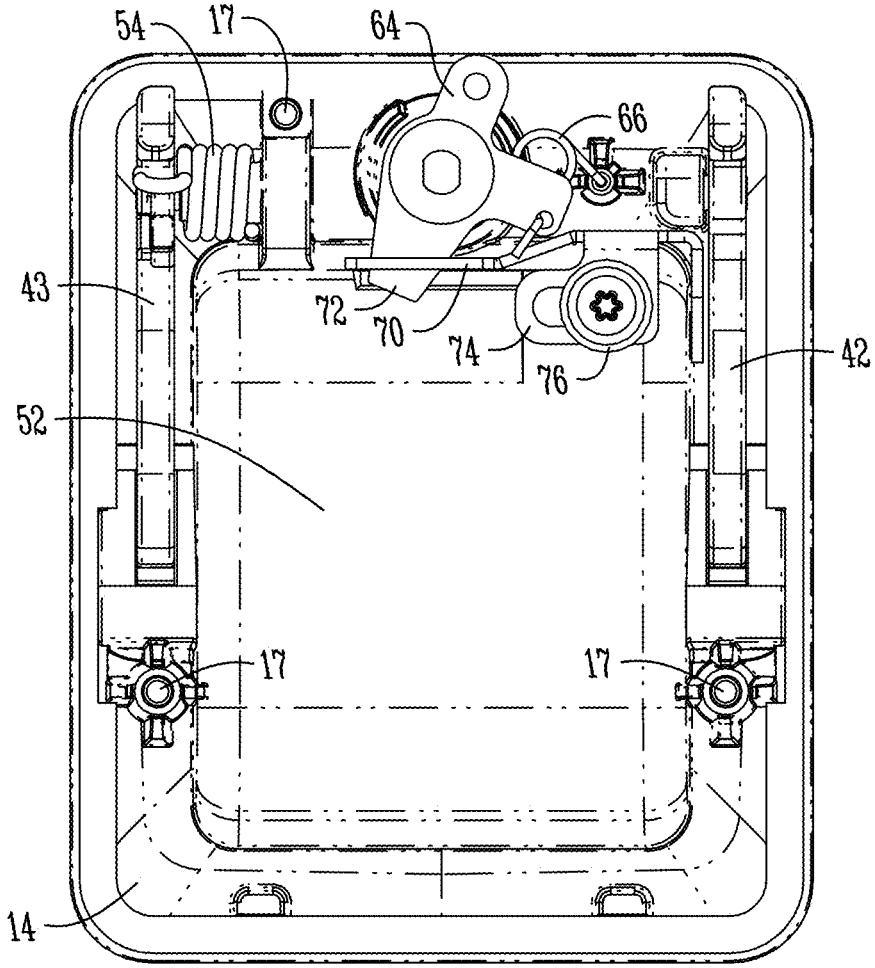
FIGS. 8A and 8B are interior plan views of the outer housing and associated components in unlocked and locked positions, respectively.
Figure 8B:
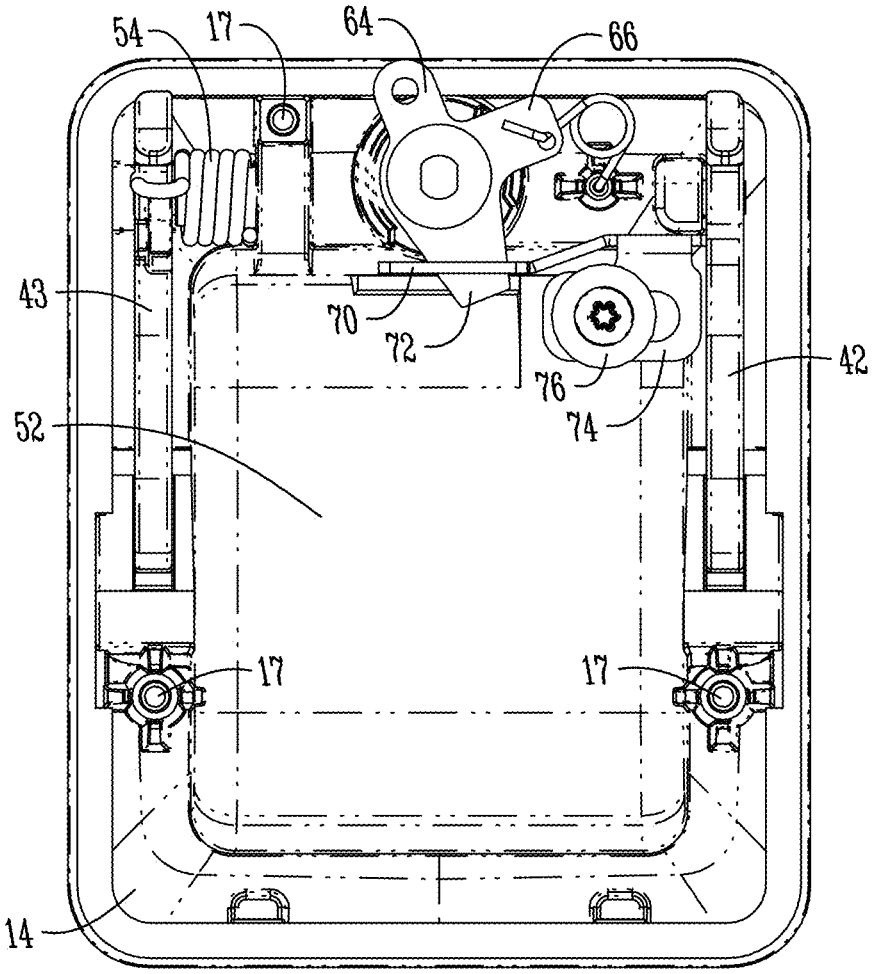
Figure 9:
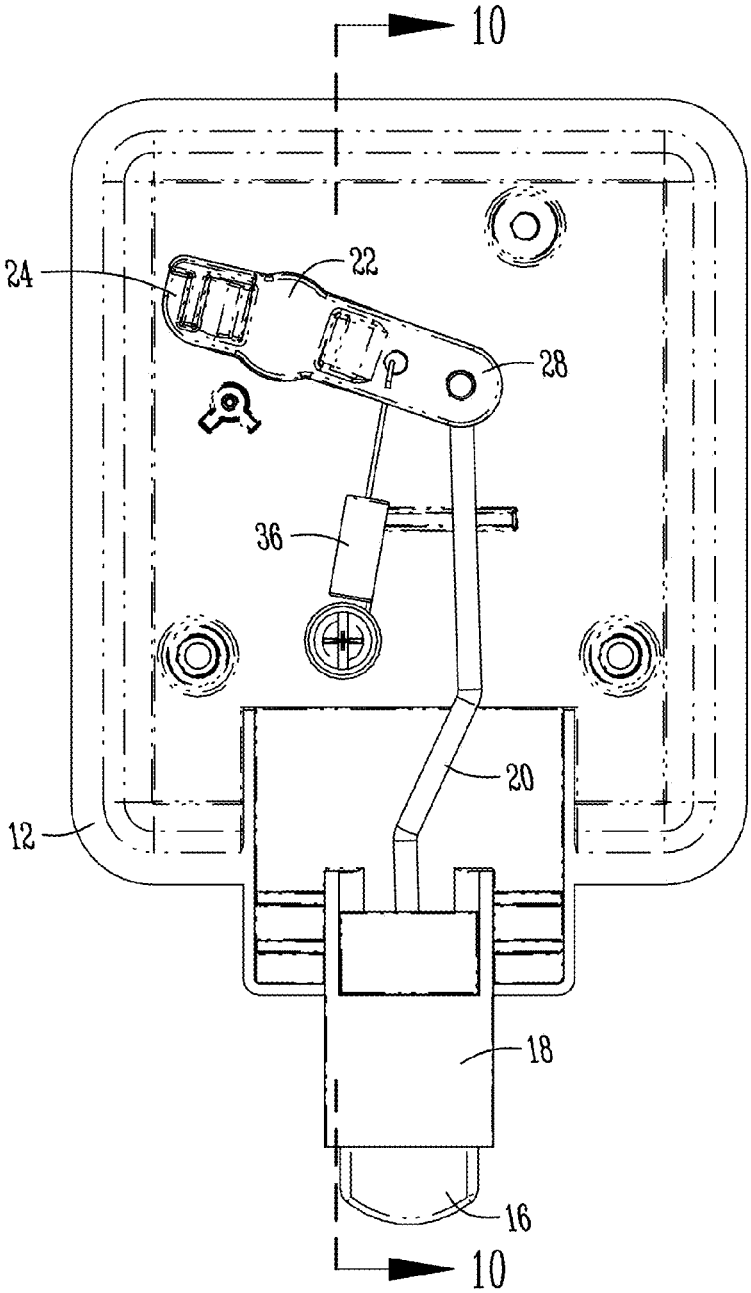
FIG. 9 is an interior plan view of the inner housing and associated components.
Figure 10:
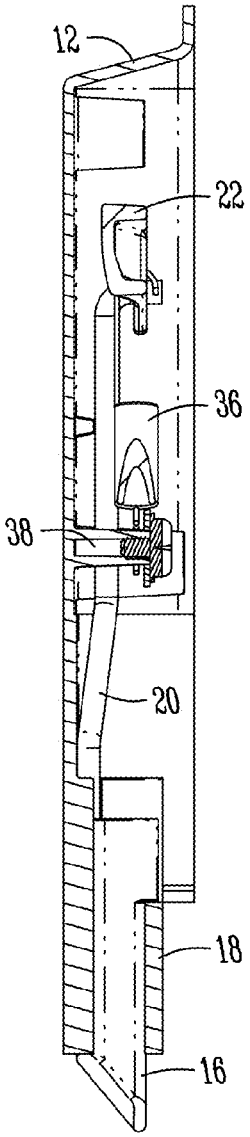
FIG. 10 is a sectional view taken along lines 10-10 of FIG. 9.
Figure 11:
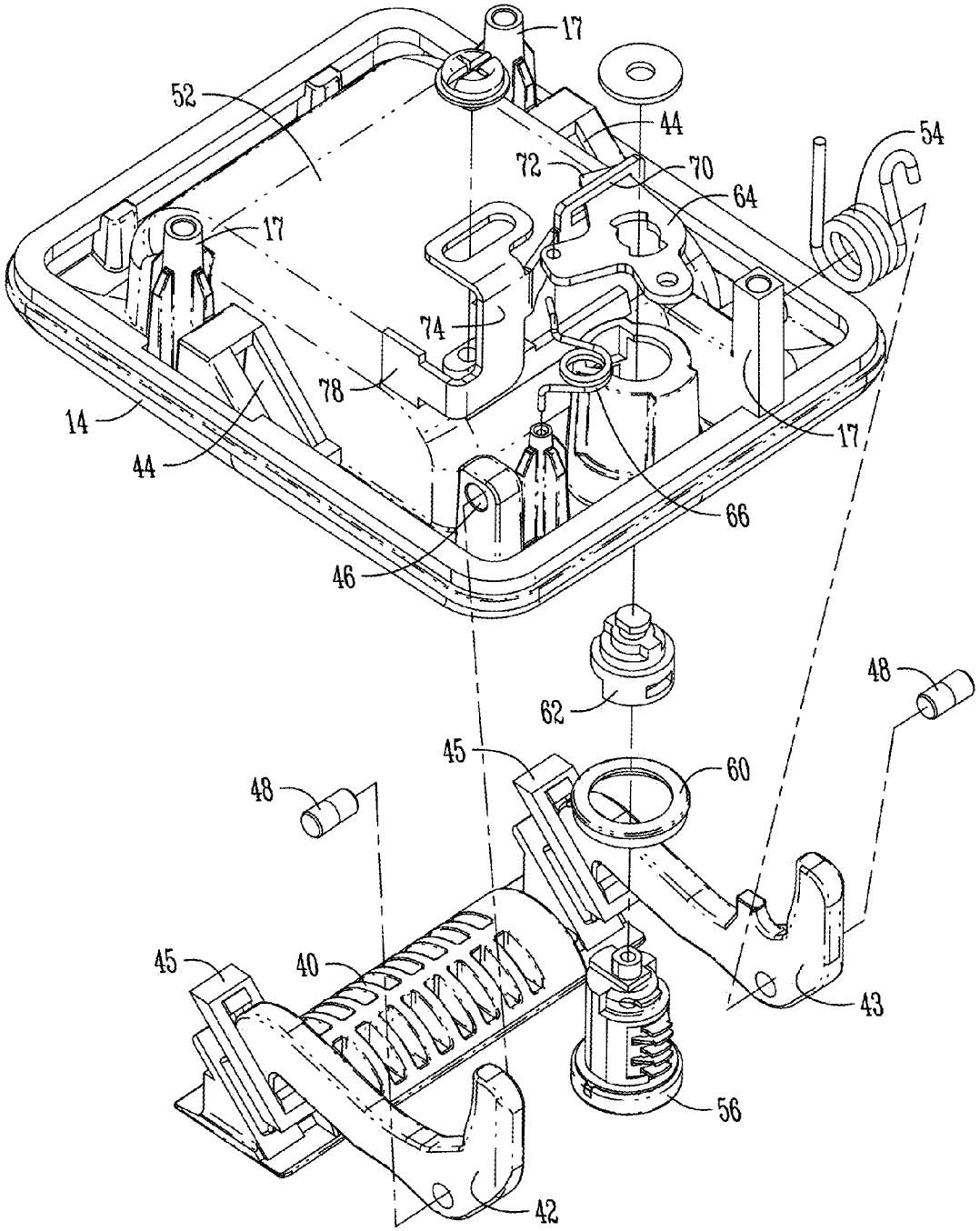
FIG. 11 is an exploded view of the outer housing and associated components.
Figure 12:
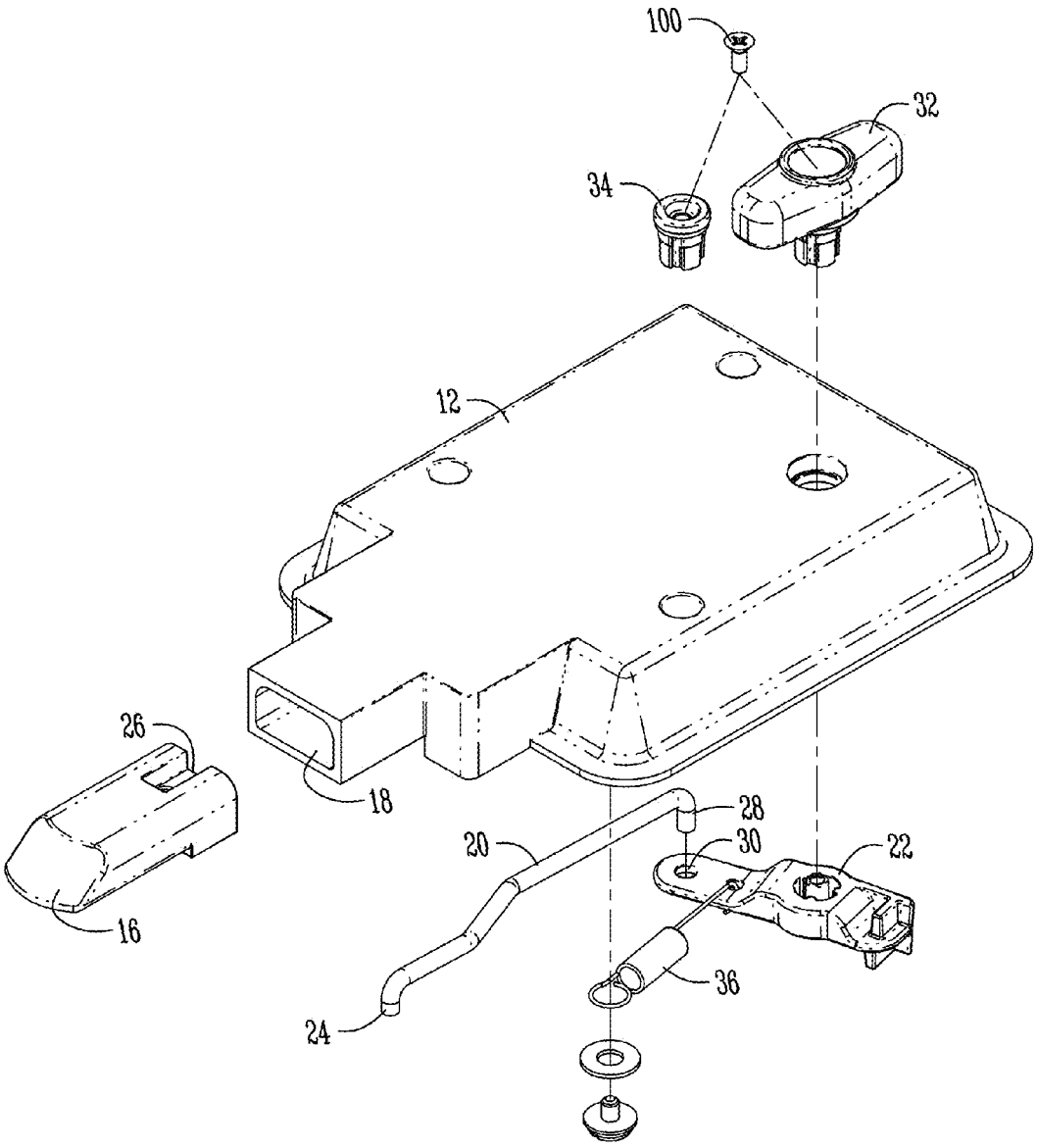
FIG. 12 is an exploded view of the inner housing and associated components.
Figure 13:
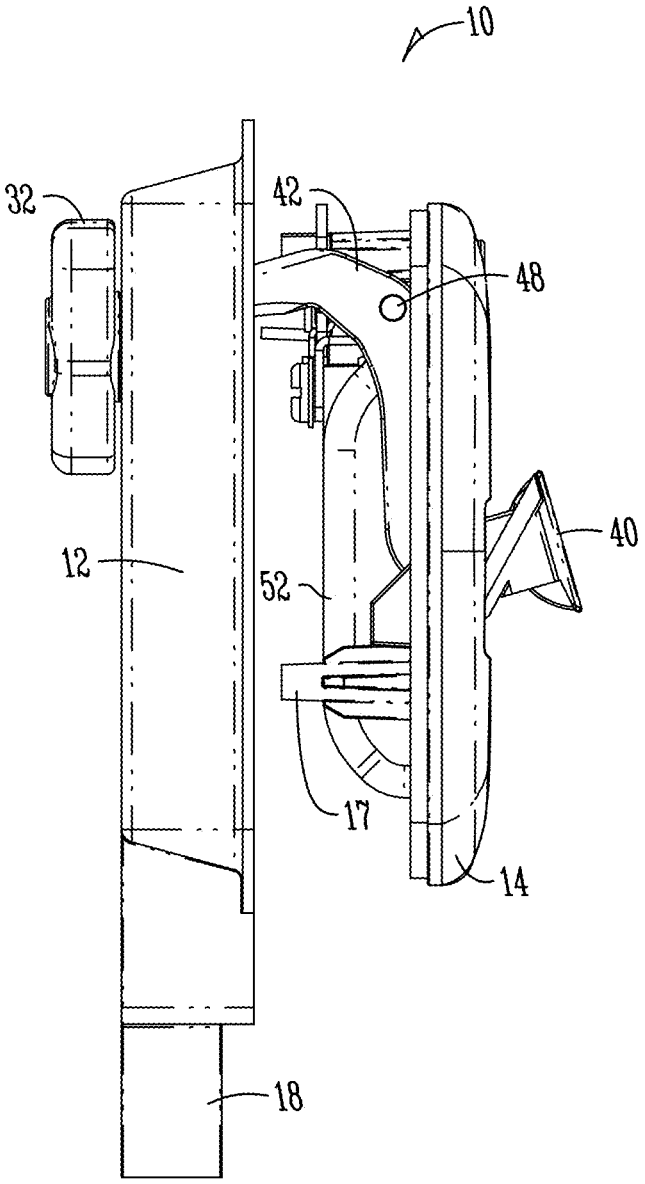
FIG. 13 is an elevation view similar to FIG. 5A, but with the handle pulled outwardly to retract the plunger.
Figure 14:
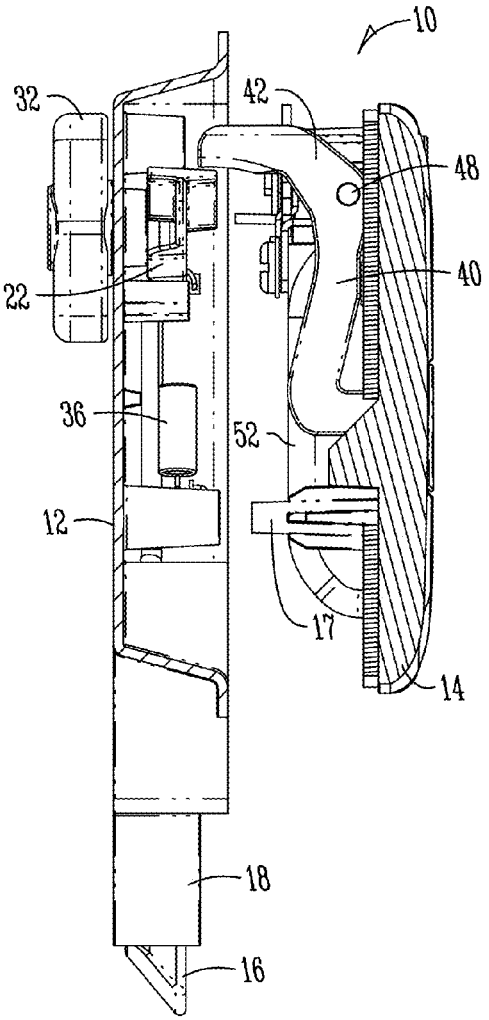
FIG. 14 is a sectional view taken along lines 14-14 of FIG. 2 with the handle in the neutral or rest position.
Figure 15:
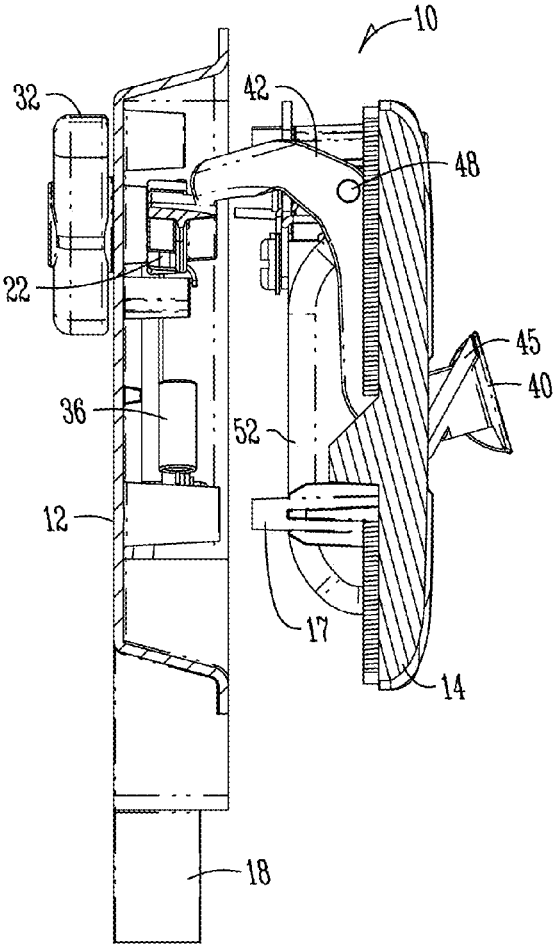
FIG. 15 is a sectional view similar to FIG. 14, but showing the handle in the pulled or actuated position.
Figure 16:
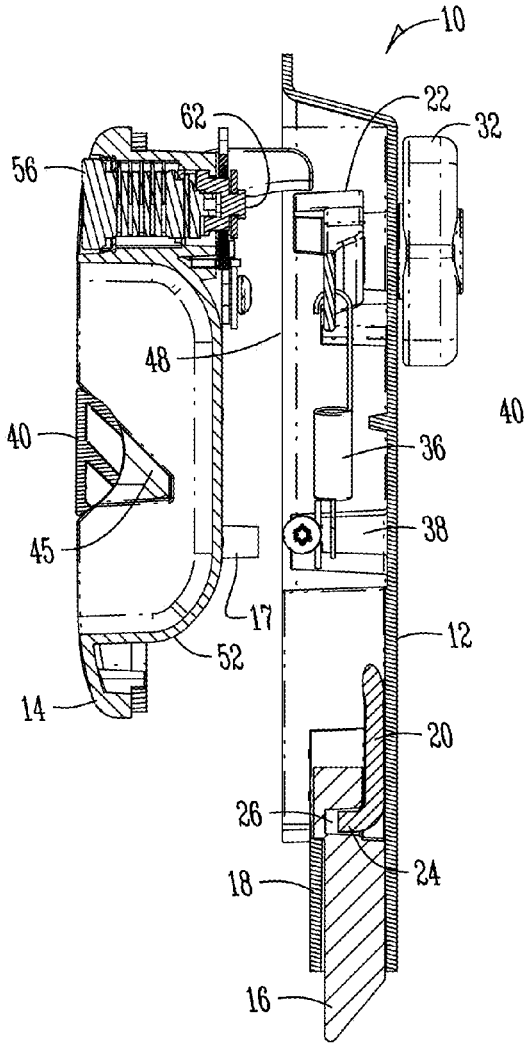
FIG. 16 is a sectional view taken along line 16-16 of FIG. 2, with the handle in the neutral or rest position.
Figure 17:
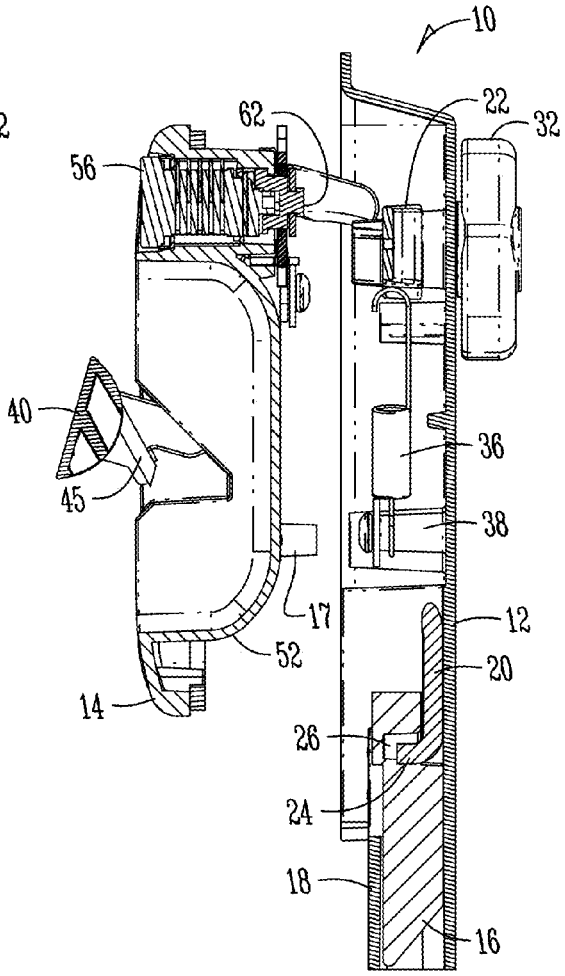
FIG. 17 is a sectional view similar to FIG. 16, but showing the handle in the pulled or actuated position.
Figure 18:
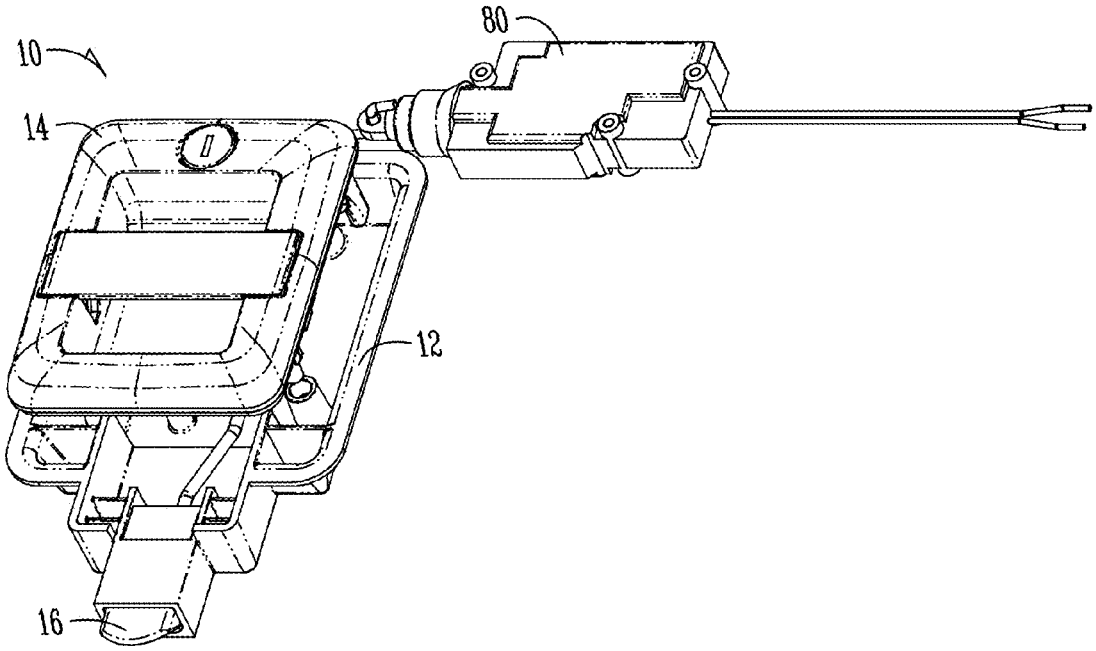
FIG. 18 is a perspective view of the handle assembly connected to a power lock actuator.
Figure 19:
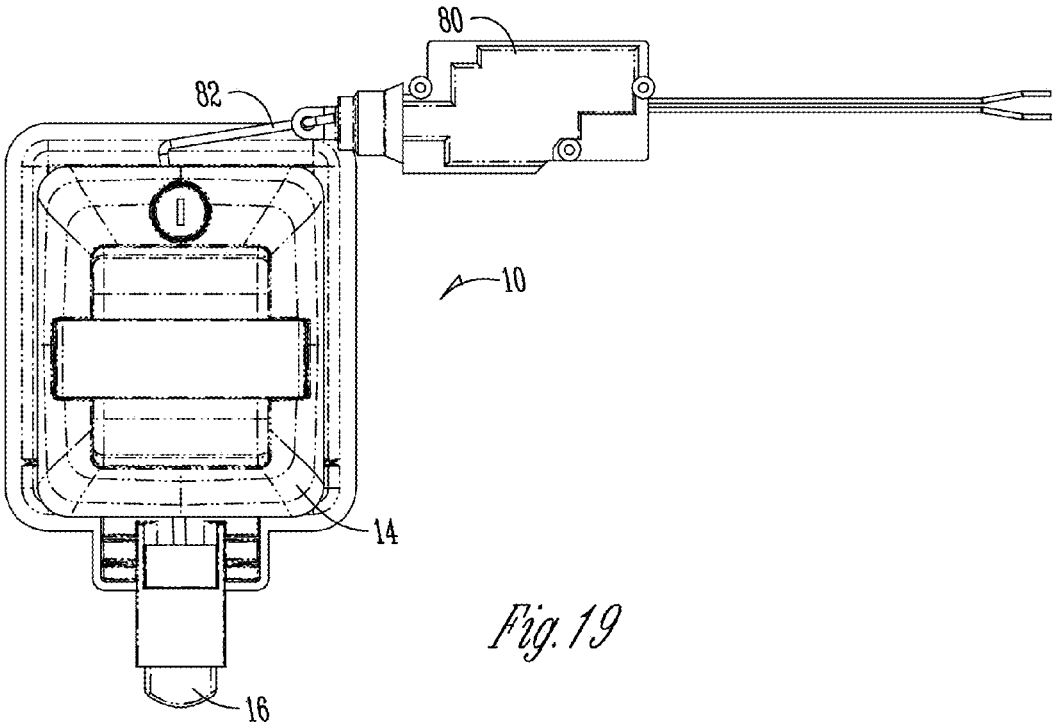
FIG. 19 is a top plan view of the assembly of FIG. 18 with the rear housing removed for clarity.
Figure 20:
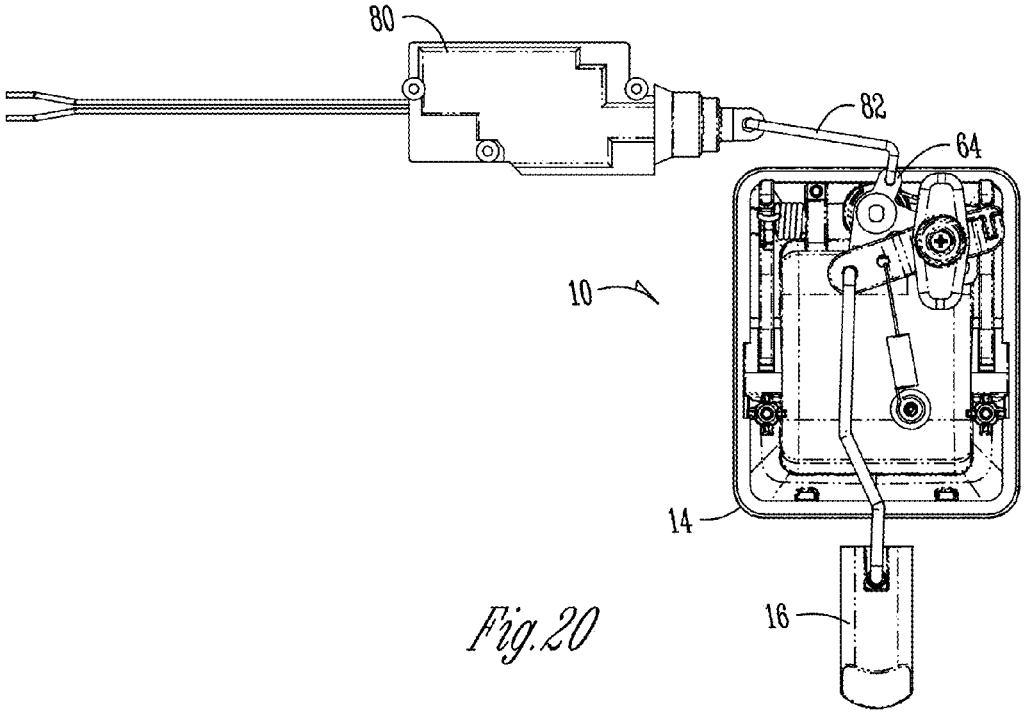
FIG. 20 is a bottom plan view of the assembly of FIG. 18.
Figure 21:
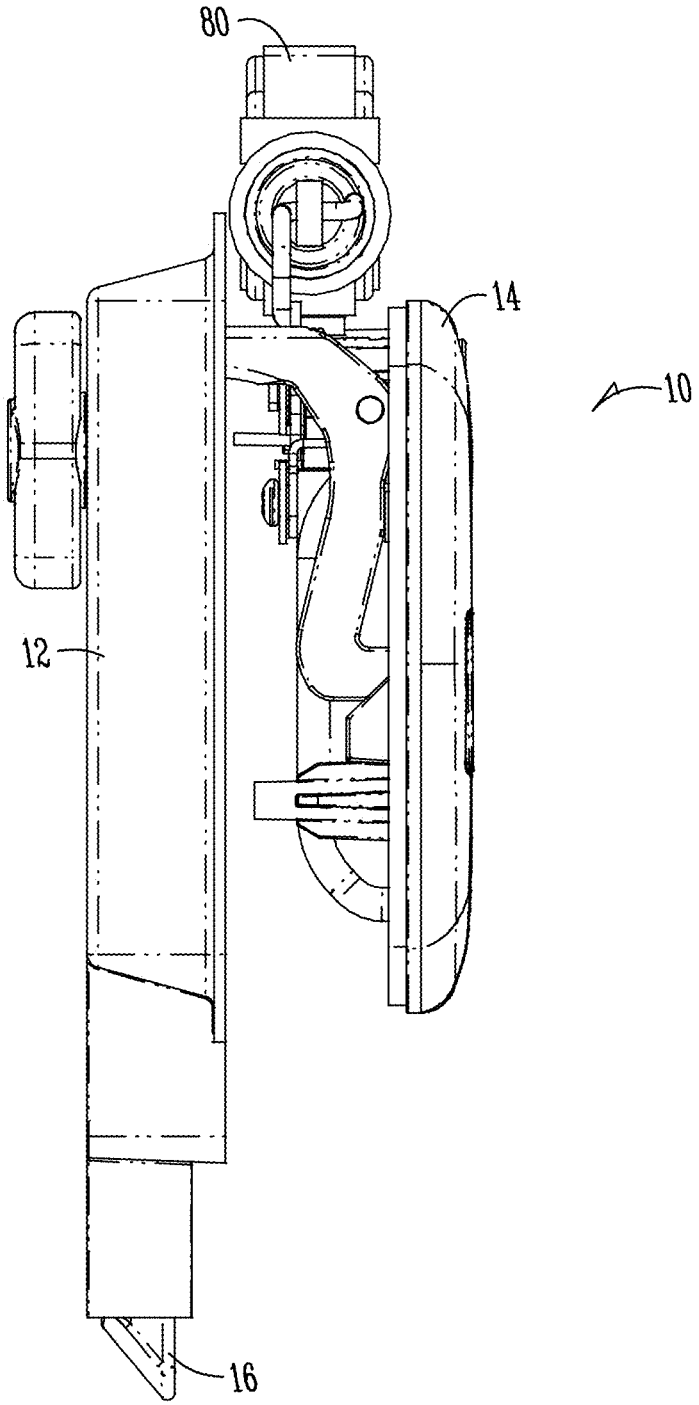
FIG. 21 is a side elevation view of the assembly of FIG. 18.

The inner housing includes a plunger 16 which is slidably mounted within a channel 18 formed on the inner housing 12. Movement of the plunger 16 between extended and retracted positions is accomplished with a rod 20 and a pivot arm 22. More particularly, the rod 20 has a bent or turned outer end 24 which is received within a slot 26 in the plunger 16, as best seen in FIGS. 9, 12, 16 and 17. The inner end 28 of the rod 20 is bent for receipt through a hole 30 in the pivot arm 22, as best seen in FIG. 12. The pivot arm 22 is mounted to the inner housing 12 in any convenient manner. In the preferred embodiment, the pivot arm 22 and an egress knob 32 are press-fit together from opposite sides of the inner housing 12 with an intermediate bushing 34. Thus, the egress knob 32 can be rotated, which in turn pivots the arm 22 so as to pull the rod 20 and retract the plunger 16 within the channel 18. It is understood that the inside egress knob 32 can be eliminated, and replaced with a cap, as seen in FIGS. 3B-7B. A spring 36 is mounted on a post 38 on the inner housing 12, with the opposite end of the spring 36 being attached to the pivot arm 22 so as to bias the plunger 16 to the extended or latching position.

The inner and outer housings 12, 14 are secured together by a plurality of screws (not shown). Preferably, the screws are recessed in the back of the inner housing 12 and extend into mounting posts 17 on the back of the outer housing 14.

A handle 40 is pivotally mounted to the outer housing 14. The handle 40 includes a pair of spaced apart legs 42,43 which extend through slots 44 on opposite sides of the outer housing 14 and are pinned to support arms 46 on the back of the outer housing 14 via pins 48. A pair of sealing gaskets 45 extend around each leg 42, 43 to seal out moisture, dust, and other contaminants from passing through the slots 44 into the interior of the handle assembly 10. Thus, the handle 40 can pivot about the axis of the pins 48 when the grip portion 50 of the handle 40 is pulled by a person. The grip portion 50 extends above and across a well 52 formed in the outer housing, and preferably is centrally mounted so that a person can grasp the grip portion 50 from either side of the well 52. Thus, when the handle assembly 10 is mounted in the door with the handle 40 extending horizontally, a person can reach their fingers into the top of the well 52 with the palm down to pull the handle 40, or alternatively can reach their fingers into the lower part of the well 52 with their palm up to pull the handle 40.

The free or terminal end of the leg 42 of the handle 40 is spaced closely to or engages the pivot arm 22. Therefore, when the handle 40 is pulled, the legs 42, 43 pivot about the pins 48, so that the leg 42 rotates the pivot arm 22 so as to move the plunger 16 from the extended latched position to the retracted unlatched position. A torsion spring 54 biases the handle 40 to the rest or neutral position, such that when the handle 40 is released, the force of the leg 42 on the pivot arm 22 is released and the pivot arm returns to the rest position by the force of the extension spring 36, so that the plunger 16 automatically returns to the extended latched position. When the compartment door is shut, either by manual force or by the force of gravity, the beveled edge of the plunger 16 will move across the door frame to push the plunger 16 back into the channel 18 to the retracted position. When the plunger 16 moves past the door frame, the bias of extension spring 36 will push the plunger 16 out of the channel 18 to the extended latched position to retain the door closed.

A lock cylinder 56 may be provided on the assembly 10 to prevent unauthorized or accidental opening of the compartment door. The key cylinder 56 is mounted in a boss 58 in the outer housing 14. An O-ring seal 60 is provided on the inner end of the cylinder 56. A rotatable actuator 62 is mounted to the inner end of the cylinder 56. A lock cam 64 is mounted on the actuator 62 for rotation therewith between a lock position and an unlock position. A spring 66 biases the lock cam 64 to the unlock position. The lock cam 64 includes a first arm 68 which extends through a slot in a guide 70. A second arm 72 of the lock cam 64 is attached to a lock arm 74 which is slidably mounted on the back side of the well 52 of the outer housing 14. A screw 76 extends through a slot on the lock arm 74 to mount the lock arm to the outer housing 14 for guiding the sliding movement of the lock arm 74. When a key is used in the cylinder 56 to lock the handle assembly 10, the cylinder 56 rotates the actuator 62, which in turns rotates the cam 64 so as to slide the lock arm 74 laterally such that a leg 78 on the lock arm 74 extends beneath the leg 43 of the handle 40 to preclude the handle 40 from being pulled from the neutral or rest position. The key can be turned in the key cylinder 56 in the opposite direction to unlock the handle assembly 10, by rotating the actuator 62 and the lock cam 64 so as to pull the lock arm 74 out of blocking engagement with the leg 43. The egress knob 32 functions independently of the lock cylinder 56, and can be operated regardless of whether the handle 40 is locked or unlocked.

The centered position of the plunger 16 allows the handle assembly 10 to be non-handed for use on any edge of a compartment door. The centered position of the handle 40 over the housing well 52 allows the handle to be grasped from either side, regardless of the horizontal or vertical orientation of the handle 40. The structure of the inner housing 12 and the plunger 16 allows the handle assembly 10 to be mounted on thin compartment doors, even less than one inch thick, without positioning the plunger 16 inside the door between the inner and outer skins.

The structure and components of the handle assembly provides several advantages over conventional compartment door handles, both in installation and in use. The construction of the handle assembly 10 allows the assembly to be used on a solid foam door with a single extruded cut-out extending through the door. Also, the depth of the pivot arm 22 and the height of the handles legs 42, 43 allow the handle assembly 10 to be used on a variety of doors having varying thickness. A spacer can be used between the inner and outer housings 12, 14 for use of the assembly on extremely thin doors. The extension spring 36 on the pivot arm 22 eliminates the need for a spring on the plunger 16, which allows a smaller plunger design without sacrificing plunger strength. The lock arm 74 locks the outside handle 40, while allowing the egress knob or handle 32 to work independently, even when the door is locked. Thus, the egress handle 32 is a safety feature in the event that the door accidentally closes on a person inside a large storage compartment. The torsion spring 54 on the handle 40 assures that the door will remain securely closed without requiring or depending on a mating configuration between the components of the inner and outer housings 12, 14. Also, the position of the key cylinder 56 on the outer housing 14, rather than on the handle 40, allows the assembly 10 to accommodate power actuation by a remote key fob, if desired. The low profile of the egress handle 32 also avoids accidental opening of the door by cargo behind the door.

FIGS. 18-21 show the handle assembly 10 with an optional power lock actuator 80. The actuator 80 includes a 12 volt reversible electric motor which provides a push-pull output and is connected to the lock cam 64 via a rod 82.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A handle assembly for a vehicle baggage door pivotal between open and closed positions and having an outer skin and an inner skin, the assembly comprising:

an outer housing mounted on an exterior surface of the outer skin;

an inner housing mounted on an exterior surface of the inner skin opposite the outer housing and having an integrally formed plunger channel;

the inner and outer housings being secured together with the door skins being sandwiched between the inner and outer housings when the handle assembly is installed;

a handle pivotally mounted on the outer housing for movement about a pivot axis;

a plunger slidably mounted in the plunger channel of the inner housing and residing on the exterior side of the inner skin of the door;

the plunger being moveable in a linear path between an extended latched position to retain the door in the closed position and a retracted unlatched position to allow pivotal movement of the door to the open position; and the handle being pivotal between a neutral position wherein the plunger is in the extended position and a pulled position to retract the plunger; and the pivot axis of the handle being perpendicular to the path of a movement of the plunger; and wherein the outer housing has a recess, and the handle is mounted substantially centrally across the recess to define two spaced apart fingers openings on opposite ends of the recess, with the handle residing between the finger openings for gripping from either end of the recess.

2. The handle assembly of claim 1 further comprising an egress knob pivotally mounted on the inner housing for movement between a neutral position wherein the plunger is in the extended latched position and a rotated position to retract the plunger to the unlatched position.

3. The handle assembly of claim 2 wherein the handle and the egress knob operate independently of one another.

4. The handle assembly of claim 1 further comprising a lock mounted in the outer housing and rotatable between an unlocked position wherein the handle is free to pivot and a locked position wherein the handle is precluded from pivoting.

5. The handle assembly of claim 1 wherein the plunger is biased towards the extended latched position.

6. The handle assembly of claim 1 wherein the handle is biased towards the neutral position.

7. The handle assembly of claim 1 wherein the handle has an outer surface which is flush with an outer surface of the outer housing when the handle is in the neutral position.

8. The handle assembly of claim 1 further comprising a pivot arm pivotally mounted in the inner housing, and a rod extending between the plunger and the pivot arm.

9. The handle assembly of claim 8 wherein the handle includes a leg to pivot the pivot arm when the handle is pulled to the pivoted position and thereby moves the plunger to the retracted unlatched position.

10. The handle assembly of claim 8 further comprising an egress knob pivotally mounted on the inner housing and connected to the lock arm to pivot the lock arm and thereby move the plunger to the retracted unlatched position.

11. A handle assembly for a pivotal compartment door mounted in a door frame for pivotal opening and closing movement, the door having opposite inside and outside surfaces, the assembly comprising:

inner and outer housings adapted to reside opposite one another and secured together on the inside and outside surfaces of the door, respectively with the door sandwiched between the housings after the handle assembly is installed;

a plunger slidably mounted in the inner housing and being slidable in opposite directions between a latched position extending from the inner housing and an unlatched position retracted into the inner housing;

a handle on the outer housing and being pivotal about a pivot axis to move the plunger from the latched position, for maintaining the door closed, to the unlatched position, for opening the door;

the outer housing having a recess extending beneath and beyond the handle to form opposite finger openings on opposite sides of the handle such that the handle can be grasped and pulled from opposites sides to unlatch the plunger; and the pivot axis being perpendicular to the slidable directions of the plunger.

12. The handle assembly of claim 11, wherein the plunger resides exterior to the door inner surface.

13. The handle assembly of claim 11 wherein the inner housing is adapted to be surface mounted to the inside surface of the door.

14. The handle assembly of claim 11 further comprising a rotatable knob on the inner housing to move the plunger from the extended latched position to the retracted unlatched position.

15. The handle assembly of claim 14 wherein the handle and knob move the plunger independently.

16. The handle assembly of claim 11 further comprising a key cylinder in the outer housing to lock the handle against pivotal movement.

17. The handle assembly of claim 11 wherein the plunger is biased to the extended latched position.

18. The handle assembly of claim 11 wherein the inner and outer housings are formed as separate pieces.

* * * * *